United States Patent [19]

Pagdin

[11] Patent Number: 4,531,679

[45] Date of Patent: Jul. 30, 1985

[54] ELECTROMAGNETICALLY-OPERABLE FLUID INJECTION

[75] Inventor: Brian C. Pagdin, Dunstable, England

[73] Assignee: Solex (U.K.) Limited, Middlesex, England

[21] Appl. No.: 623,535

[22] Filed: Jun. 22, 1984

Related U.S. Application Data

[63] Continuation of Ser. No. 370,585, Apr. 21, 1982, abandoned.

[30] Foreign Application Priority Data

Apr. 29, 1981 [GB] United Kingdom ..... 8113177

[51] Int. Cl.[3] ..... B05B 1/30

[52] U.S. Cl. ..... 239/585; 251/141

[58] Field of Search ..... 239/584, 585; 251/120, 251/141

[56] References Cited

U.S. PATENT DOCUMENTS

| | | | |
|---|---|---|---|
| 1,711,767 | 5/1929 | Barden | 251/141 X |
| 3,738,578 | 6/1973 | Farrell | 239/585 |
| 3,819,116 | 6/1974 | Goodinge et al. | 239/102 |
| 3,949,938 | 4/1976 | Goodinge | 239/102 |
| 4,142,683 | 3/1979 | Casey et al. | 239/585 |
| 4,166,577 | 9/1979 | Elwell | 239/102 |
| 4,308,890 | 1/1982 | Saito | 251/141 X |

FOREIGN PATENT DOCUMENTS

| | | | |
|---|---|---|---|
| 0007724 | 6/1980 | European Pat. Off. . | |
| 0006769 | 11/1981 | European Pat. Off. . | |
| 2541033 | 3/1977 | Fed. Rep. of Germany | 251/141 |
| 2719729 | 11/1977 | Fed. Rep. of Germany . | |
| 7504592 | 1/1973 | France . | |
| 7327182 | 7/1973 | France . | |
| 55-82877 | 6/1980 | Japan | 251/141 |
| 1330181 | 9/1973 | United Kingdom . | |
| 1414371 | 11/1975 | United Kingdom . | |
| 1516939 | 7/1978 | United Kingdom . | |
| 2031064A | 4/1980 | United Kingdom . | |
| 2033004 | 5/1980 | United Kingdom . | |
| 2074233A | 10/1981 | United Kingdom . | |

*Primary Examiner*—Andres Kashnikow
*Assistant Examiner*—Daniel R. Edelbrock
*Attorney, Agent, or Firm*—Parkhurst & Oliff

[57] ABSTRACT

A single-point fuel injection system including an electromagnetically-operable ball valve injector. The injector comprises a hollow body which is surrounded by an annular gallery through which fuel is circulated under pressure continuously. Inlet ports are formed in the body whereby fuel from the gallery enters a chamber within the body in a direction transverse to the axis of the injector. The chamber communicates with the nozzle orifice via an aperture within which the ball valve is located. The difference between the diameter of the aperture and the diameter of the ball is sufficiently small to restrict fuel flow from the chamber to the nozzle orifice so that the valve is urged to seat and close the nozzle orifice by the differential fluid pressure loading on it.

19 Claims, 3 Drawing Figures

ELECTROMAGNETICALLY-OPERABLE FLUID INJECTION

This is a continuation of application Ser. No. 370,585 filed Apr. 21, 1982, now abandoned.

This invention relates to electromagnetically-operable fluid injectors and particularly, although not exclusively, to electromagnetically-operable fuel injectors, and to single point fuel injection systems for internal combustion engines.

U.S. Pat. Nos. 3,731,880 and 3,865,312 and U.K. Patent Specifications Nos. 1,330,181 and 2,033,004A disclose various forms of electromagnetically-operable fuel injectors. European Patent Publications Nos. 0 006 769A and 0 007 724A disclose single point fuel injection systems incorporating such fuel injectors.

An object of this invention is to provide an electromagnetically-operable fluid injector suitable for use in a single point fuel injection system which is capable of high frequency operation and which is arranged so that the efficiency of the magnetic circuit is maximised.

An electro-magnetically-operable fluid injector in which this invention is embodied comprises a hollow body of magnetic material which carries an injector nozzle which forms a nozzle orifice, the hollow interior of the body forming a chamber and an aperture or conduit which extends from the chamber to the nozzle orifice, the aperture communicating with the chamber at one end and with the nozzle orifice at its other end, a fluid inlet arrangement through which fluid is fed into said chamber under pressure, a solenoid core connected to the body so that it projects into the chamber opposite the aperture and the nozzle with which it is coaxially aligned, a solenoid winding wound around the core, a valve seat which is formed around the nozzle orifice at its end which communicates with the aperture and a valve of magnetic material which co-operates with the valve seat to control fluid flow along a flow path from the chamber to the orifice, the valve and the body including the core, being in a magnetic circuit which is magnetized by energization of the solenoid winding, the valve being a movable part of the magnetic circuit and being located in a gap which is formed in that magnetic circuit between one pole, which is formed by the solenoid core, and another pole which is formed by that part of the body which forms the periphery of the aperture, the valve being normally-biased to seat on the valve seat and shut off fluid flow from the chamber into the orifice and being unseated to allow fluid flow along said path to the orifice and thereby to effect fluid injection by a change in the state of energization of the solenoid winding, wherein the improvement comprises the body and the valve being arranged so that the dimensions of the flow path from the chamber to the nozzle orifice are such that fluid flow along that path is restricted.

Preferably the flow path by which the chamber communicates with the nozzle orifice comprises a peripheral passage of flow restricting dimensions which is formed around the valve between the valve and the periphery of the aperture or conduit. Alternatively the valve may be a sliding fit in the aperture and the flow path by which the chamber communicates with the nozzle orifice may comprise at least one passage of flow restricting dimensions which by-passes the aperture.

Preferably the valve is a ball valve.

According to another aspect of this invention there is provided a single point fuel injection system for an internal combustion engine including an electromagnetically-operable fuel injector operable to inject liquid fuel into an air/fuel induction system of the engine, a source of liquid fuel and means for feeding liquid fuel under pressure from said source to the injector, in which the injector comprises a hollow body of magnetic material which carries an injector nozzle which forms a nozzle orifice, the hollow interior of the body forming a chamber and an aperture which extends from the chamber to the nozzle orifice, the aperture communicating with the chamber at one end and with the nozzle orifice at the other end, a liquid fuel inlet arrangement through which liquid fuel fed to the injector under pressure by said means is fed into said chamber, a solenoid core connected to the body so that it projects into the chamber opposite the aperture and the nozzle with which it is coaxially aligned, a solenoid winding wound around the core, a valve seat which is formed around the nozzle orifice at its end which communicates with the aperture, and a valve of magnetic material which co-operates with the valve seat to control fuel flow from the chamber to the orifice, the valve and the body, including the core, being in a magnetic circuit which is magnetized by energization of the solenoid winding, the valve being a movable part of the magnetic circuit and being located in a gap which is formed in that magnetic circuit between one pole, which is formed by the solenoid core and another pole which is formed by that part of the body which forms the periphery of the aperture, the valve being normally-biased to seat on the valve seat and shut off fuel flow from the chamber into the orifice and being unseated to effect fuel injection by a change in the state of energization of the solenoid winding, wherein the improvement comprises the body and the valve being arranged so that the dimensions of the flow path from the chamber to the nozzle orifice are such that fluid flow along that path is restricted.

Preferably said means for feeding liquid fuel under pressure to the injector include a fuel passage which is bounded by the outer surface of the hollow body so that it extends at least partway around the hollow body, and said liquid fuel inlet arrangement comprises at least one short inlet passage which extends through the hollow body so as to connect said fuel passage to said chamber and which is adapted to direct fuel under pressure from said fuel passage into said chamber in a direction which is transverse to the axis of the core and the nozzle orifice.

A single point fuel injection system incorporating an electromagnetically-operable fuel injector in which this invention is embodied is described now by way of example with reference to the accompanying drawings, of which:

Figure 1:
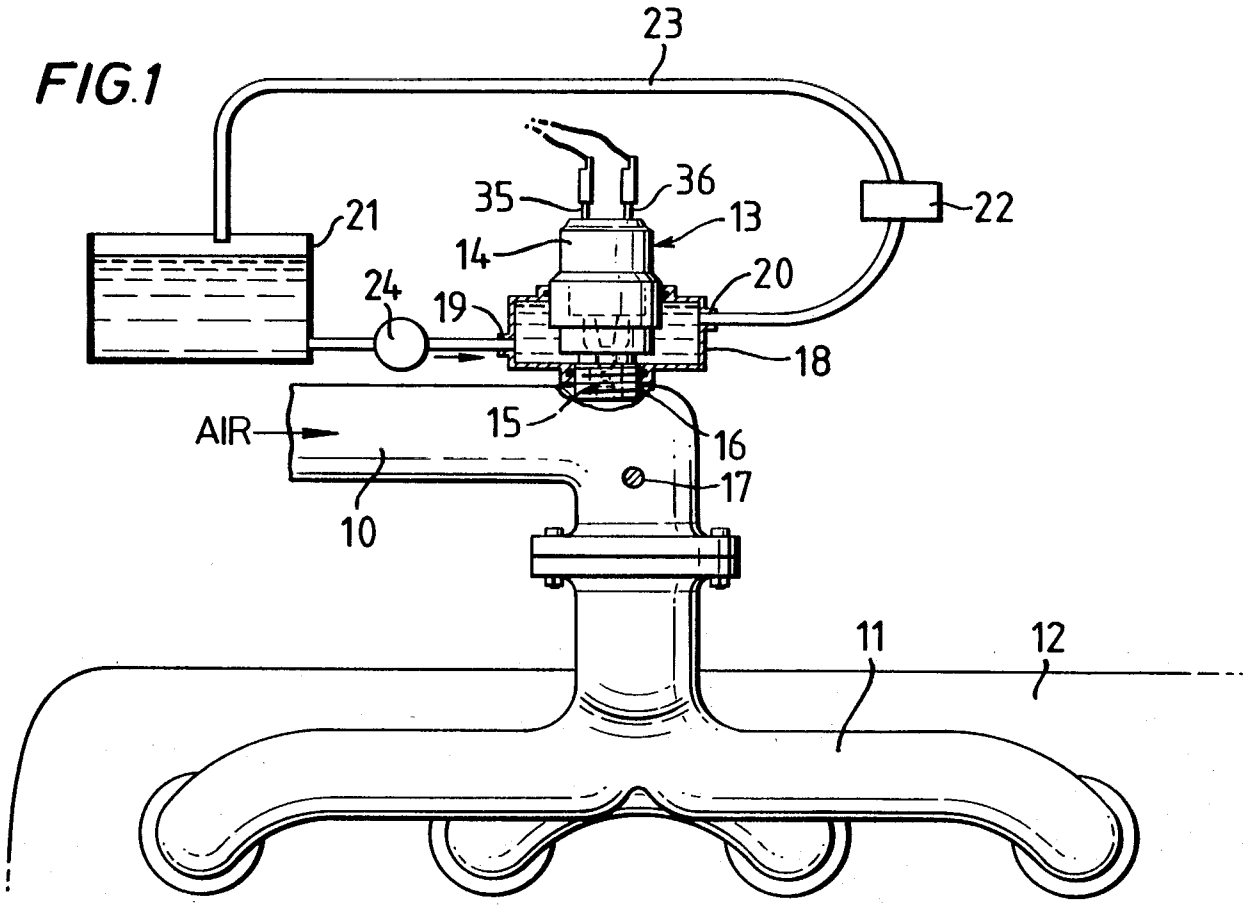
FIG. 1 is a schematic illustration of the fuel injection system.

FIG. 1 shows an air induction pipe 10 joined to a branched engine inlet manifold 11 in the usual way, the pipe 10 and the manifold 11 cooperating together in the usual way to form a path for air drawn through the usual air cleaner (not shown) to each cylinder of the engine 12 by operation of the engine 12. The fuel injector 13 comprises a hollow body 14 of magnetic material which carries an injector nozzle 15 and which is screwed into an aperture 16 in the air induction pipe 10 so that the nozzle orifice communicates with the interior of the induction pipe 10. Hence fuel injected into the induction pipe 10 by operation of the injector 13 is presented to the air flow through the pipe 10. The usual driver-operable throttle arrangement, including a throttle spindle 17, for varying the mass flow of air to the engine 12 as required and means (not shown) for metering air flow through the pipe 10 are provided.

An annular jacket 18 is fitted around the hollow body 14 of the fuel injector 13 in a fluid tight manner so as to form an annular gallery around the body 14. The annular jacket 18 has a fuel inlet port 19 and a fuel outlet port 20. The distance, as measured along the axis of the aperture 16, between the injector nozzle 15 and the inlet port 19 is less than the corresponding distance between the injector nozzle 15 and the outlet port 20. The outlet port 20 is connected to a fuel tank 21 via a pressure regulator 22 by a return line 23. A fuel pump 24 is operable to draw fuel from the fuel tank 22 and feed it through the inlet port 19 into the annular gallery. The pressure regulator 22 is adapted to maintain a pressure in excess of 62 $kN/m^2$ (9 p.s.i.).

Figure 2:
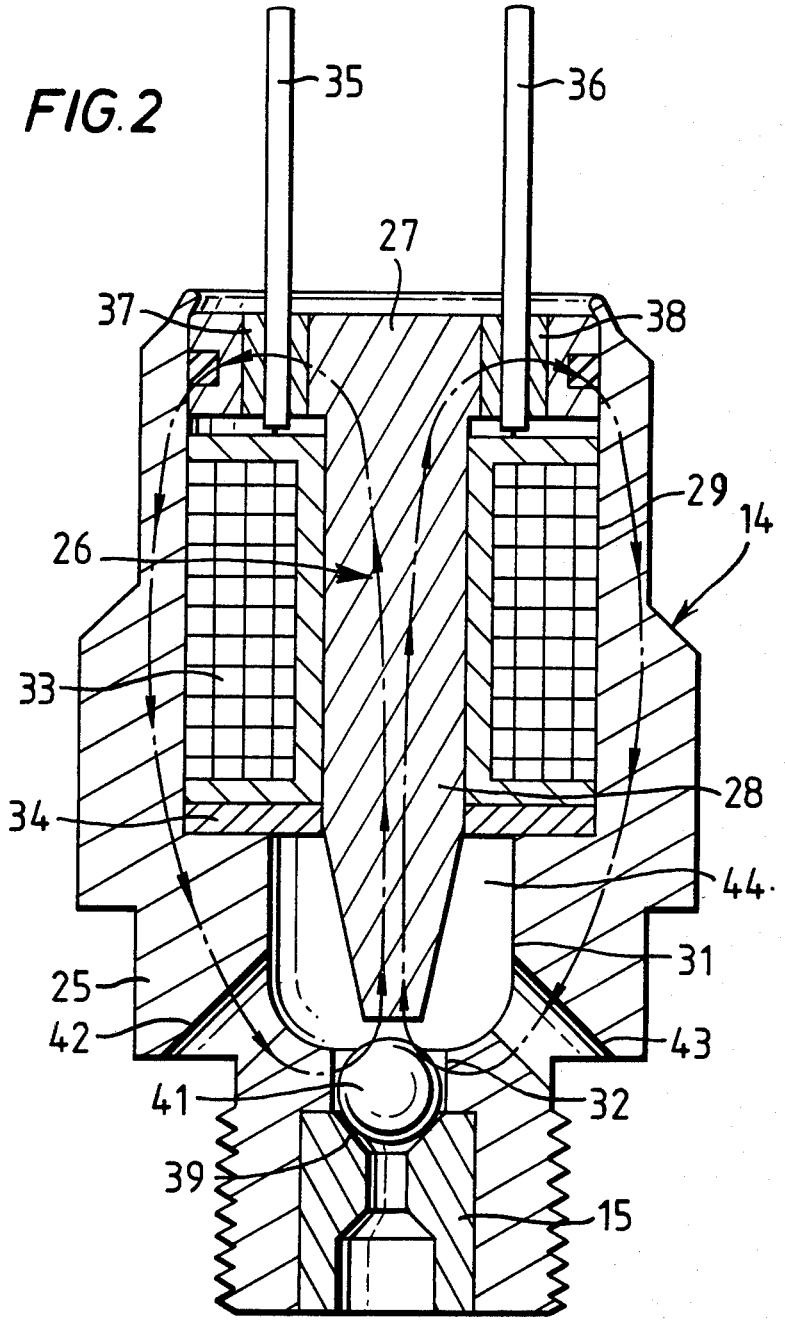
FIG. 2 is a transverse cross-section of the injector shown in FIG. 1 drawn to a larger scale and showing the magnetic flux path.
Figure 3:
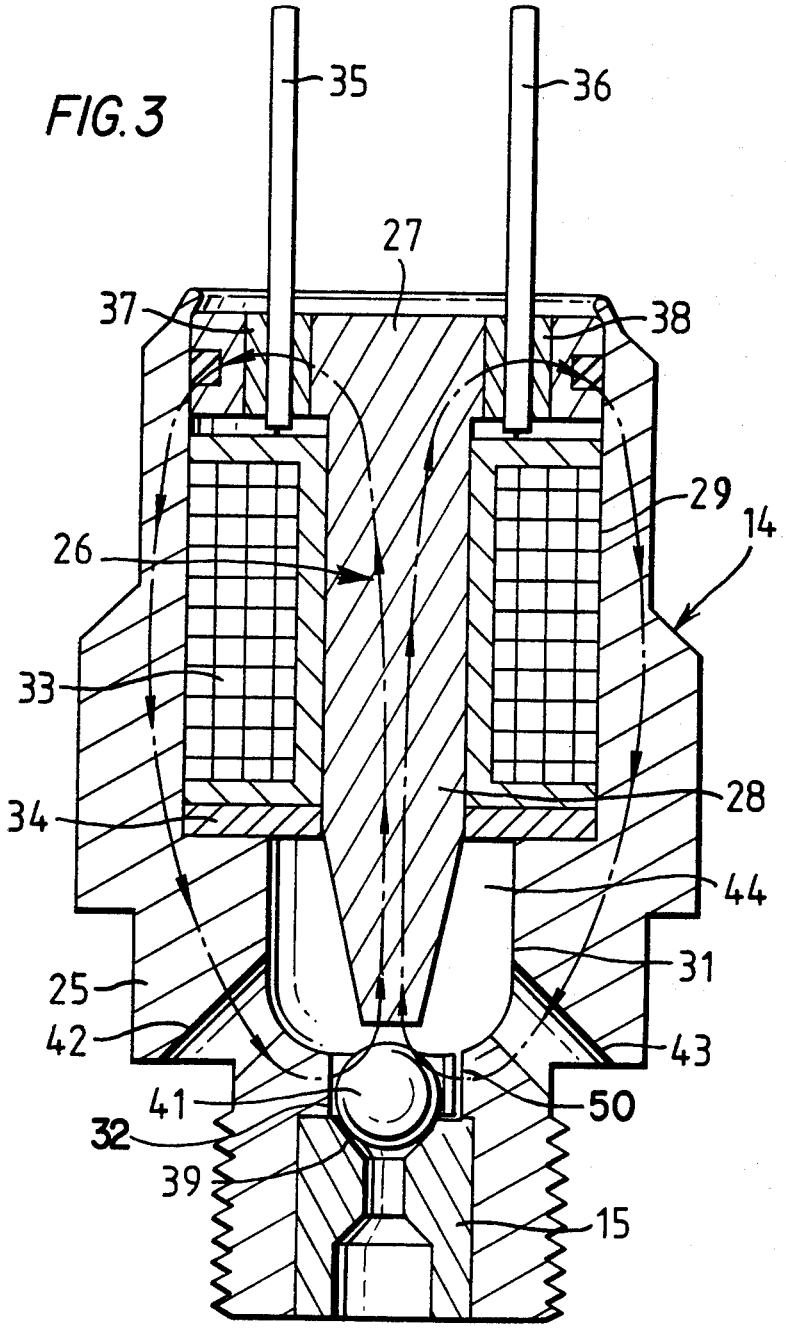
FIG. 3 is a transverse cross-section of an alternative injector having a sliding valve fit.

FIG. 2 shows that the body 14 comprises a tubular casing 25 and an insert 26. The casing 25 has a stepped through bore. The insert 26 comprises an outer end portion 27, which is spigotted in a fluid tight manner into the larger diameter end of the stepped bore, and an elongate, reduced diameter portion 28 which extends axially from the end portion 27 into the bore of the tubular casing 25 through the largest diameter portion 29 of the stepped bore and through most of an adjacent intermediate diameter portion 31 of the stepped bore to the other end of the insert 26 which is adjacent the smallest diameter portion 32 of the stepped bore. The intermediate diameter bore portion 31 is formed with an arcuate surface at its end adjacent the smallest diameter bore portion 32.

A solenoid winding 33 surrounds a core which is a major part of the elongate portion 28 and is located between the radial flange formed by the outer insert end portion 27 and an annular spacer 34, the annular spacer 34 abutting the shoulder formed between the largest diameter bore portion 29 and the intermediate diameter bore portion 31. Terminal pins 35 and 36 extend from the solenoid winding 33, to which they are connected, through insulating sleeves 37 and 38 which extend through the radial flange and are connected into an appropriate electrical control circuit (not shown). The minor end part of the elongate portion 28 that projects from the winding 33 and beyond the annular spacer 34 is tapered and serves as a flux concentrating pole piece. A flat surface is formed at the end of the pole piece towards which the taper extends.

The injector nozzle 15, which is formed of a non-magnetic material, is fitted into the smaller diameter end bore portion of the stepped through bore formed in the tubular casing 25 and abuts a shoulder formed between the smaller diameter end bore portion and the smallest diameter bore portion 32. The injector nozzle 15 and the elongate insert portion 28 are substantially coaxial. A tapered valve seat 39 is formed around the nozzle orifice at its inner end.

A ball valve 41 is located within the smallest diameter bore portion or aperature or conduit 32 between the chamber 44 and the valve seat 39. The diameter of the ball valve 41 is less than that of the smallest diameter bore portion or conduit 32, but is greater than the axial length of that bore portion or conduit 32 so that the ball valve 41 projects from both ends of the smallest diameter bore portion or conduit 32 when it is seated on the valve seat 39. The distance between the injector nozzle 15 and the adjacent end of the elongate portion or solenoid core 28 is such that the ball valve 41 is spaced from the elongate portion or solenoid core 28 when seated on the valve seat 39 and is such that the equator of the ball valve 41 is always located within the smallest diameter bore portion or conduit 32 even when the ball valve 41 is unseated and abuts the elongate portion 28.

As clearly shown in FIG. 2, the gap between ball valve 41 at its equator and the conduit 32 is quite restricted. The ball valve, solenoid projecting end, valve seat, and conduit are designed so that when the ball valve is fully unseated and abuts the solenoid core projecting end, the distance between the ball valve and the valve seat 39 is greater than the restricted gap between the valve and the conduit. Due to this design the greatest fluid restriction in the fluid flow path is between the ball valve and the conduit thereby resulting in an additional fluid closure effect urging the unseated valve towards the valve seat.

Passages 42 and 43 in the tubular casing 25 communicate with a chamber 44 which is formed by the intermediate diameter bore portion 31 and into which the core projects opposite the aperture formed by the smallest diameter bore portion 32. The passages 42 and 43 communicate with the annular gallery formed around the body 14 by the annular jacket 18 and thus serve as inlet ports by which liquid fuel under pressure enters the chamber 44 from the annular gallery in a direction transverse to the longitudinal axis of the body 14. It is desirable that the volume of the chamber 44 is as small as is practicable in order to minimise the instance of fuel vapour forming and being trapped therein. It is also desirable for the inner ends of the passages 42 and 43 to be as close as is practicable to the aperture formed by the smallest diameter bore portion 32 in order to reduce the risk of fuel vapour passing through that aperture to the nozzle with liquid fuel.

In operation of the injector, fuel pressure in the fuel chamber 44 acts to seat the ball valve 41 so that that chamber 44 is shut off from the orifice of the injector nozzle 15. Energization of the solenoid winding 33 by an external source of electrical potential under the control of suitable control apparatus, which is incorporated in the electrical control circuit, induces magnetic flux flow in the magnetic circuit formed by the walls of the largest, intermediate and smallest diameter bore portions 29, 31 and 32 of the tubular casing 25, the ball valve 41 and the insert 26 as indicated in FIG. 2, the ball valve 41 being a movable part of that magnetic circuit and being located in the gap that is formed in that magnetic circuit between one pole, which is formed by the end of the elongate insert portion 28, and another annular pole which is formed by the wall of the smallest diameter bore portion 32. Hence the magnetic circuit is magnetized. The direction of that magnetic flux is such that the ball valve 41 is unseated and moved against the action of fuel pressure on it into abutment with the adjacent end of the elongate portion 28 thus allowing fuel to pass it from the fuel chamber 44 into the orifice of the injector nozzle 15 for injection. The solenoid winding 33 is energized for a predetermined time interval in accordance with the engine requirements by a pulse of a controlled duration. At the end of that pulse, the winding 33 is de-energized, the magnetic circuit de-magnetized and the ball valve 41 is reseated by the resultant of the complex action of fluid forces acting on it.

The difference between the diameter of the ball valve 41 and the diameter of the smallest diameter bore portion or conduit 32 around the ball valve 41 is sufficiently small to restrict fuel flow past the ball valve 41 to the orifice of the nozzle 15 so that the pressure differential urging the unseated ball valve 41 towards the valve seat 39 is substantially greater than it would be if there was no such restriction to fuel flow passed the ball valve 41. Fuel flows along a flow path that includes a path from the chamber 44 to the nozzle orifice. The diameters of the ball valve and conduit are selected so that fluid flow between them is restricted, which results in the fluid flow along that part of the flow path being restricted when the valve is unseated. Hence the time required to reseat the ball valve 41 following de-energization of the solenoid winding 33 is less than it would be if there was no such restriction to fuel flow passed the ball valve 41.

The ball valve is the only moving part of the magnetic circuit. Hence the mass of the moving part is minimized. Minimization of the valve mass minimizes the force required to unseat it and is optimized by the use of a ball valve.

The arrangement of the annular gallery around the injector 13, including the location of the inlet and outlet ports 19 and 20 relative to the nozzle orifice, leads to a minimization of risk that fuel vapour might be conveyed into the chamber 44 through the passages 42 and 43 whilst the engine 12 is running under its own power, since any fuel vapour which may be formed in the system when the engine 12 is hot and not operating, will be purged from the annular gallery and elsewhere in the system, via the outlet port 20, by the fresh fuel flow induced by initial operation of the pump 24 whilst the engine 12 is being cranked so that only liquid fuel is contained in the annular gallery and the fuel chamber 44 when the engine 12 fires first and runs under its own power.

In an alternative form of injector 13 in which this invention is embodied, the ball valve 41 is a sliding fit in the smallest diameter bore portion 32, and one or more passages of flow restricting dimensions 50 are formed in the body 14 and the nozzle 15 connecting the chamber 44 with a location between the upstream end of the nozzle orifice and the annular area of the ball valve 41 that contacts the valve seat 39 when the ball valve 41 is seated.

The arrangements just described are satisfactory for normal dynamic operating conditions in which the chamber 44 is supplied with fuel under sufficient pressure viz. in excess of 62 $kN/m^2$ (9 p.s.i.) to ensure closure of the valve. It might be that the injector 13 is used in an air/fuel induction system in which the forces acting on the valve when the injector is rendered inoperative are not sufficient to ensure that the valve is seated in a leak proof manner. Those valve forces could be augmented by the effects of residual magnetism between the ball and the seat if the seat is formed of a suitable magnetic material. It also might be that, in certain operational situations, the fuel pressure is not sufficient to ensure closure of the valve during operation of the injector. A spring could be provided to augment the forces tending to close the valve. Of course such a spring could also ensure that the valve is seated when the injector is rendered inoperative.

An injector in which this application is embodied is not limited to use as a liquid fuel injector. It could be used to inject other fluids.

I claim:

1. An electromagnetically-operable fluid injector comprising:

a hollow body of magnetic material; said hollow body having a hollow interior forming a fluid inlet chamber;

a fluid inlet arrangement which communicates with the fluid inlet chamber such that fluid under pressure fed through it is fed directly into the fluid inlet chamber;

an injector nozzle which is carried by said hollow body, said injector nozzle having top and bottom ends, said top end of said injector nozzle having a nozzle orifice and a valve seat formed around said nozzle orifice;

a conduit extending from said fluid inlet chamber to said valve seat, said conduit communicating with the chamber at a top end and with the valve seat at a bottom end;

a solenoid core connected to the hollow body and projecting into said fluid inlet chamber opposite the top end of said conduit and said injector nozzle, said solenoid core being substantially coaxially aligned with said conduit and said nozzle and tapering to a flat end surface within the fluid inlet chamber, the flat end surface being substantially flat across its entire transverse extent;

a solenoid winding wound around said solenoid core; and a valve of magnetic material, said valve having an axial length, a portion of said valve having the greatest cross-sectional area of said valve in a direction transverse to said conduit being always located within said conduit, said valve cooperating with the valve seat to control fluid flow along a flow path from said fluid inlet arrangement through said fluid inlet chamber to said nozzle orifice;

said valve and said hollow body including the core, being in a magnetic circuit which is magnetized by energization of the solenoid winding, the valve being a movable part of the magnetic circuit and being located in a gap which is formed in that magnetic circuit between one pole, which is formed by the solenoid core, and another pole which is formed by that part of the hollow body which forms the periphery of the conduit, the valve being normally biassed to seat on the valve seat and shut off fluid flow from said fluid inlet chamber into the nozzle orifice and being unseated to allow fluid flow along said path to the nozzle orifice and thereby to effect fluid injection by change in the state of energization of the solenoid winding;

said fluid inlet arrangement communicating with said fluid inlet chamber through a portion of the hollow body without passing through said solenoid core, and said solenoid core end surface having a cross-sectional area substantially less than said greatest cross-sectional area of said valve; and means defining a fluid restricting passageway having a top end, a bottom end and a minimum cross-sectional area, said passageway communicating with said chamber at its top end and with the valve seat at its bottom end and thereby providing a restriction in part of the flow path from said fluid inlet chamber to the nozzle orifice;

the substantially flat end surface of said solenoid core and the valve seat defining a dimension therebetween, the axial length of said valve, the dimension between the flat end of said solenoid core and said valve seat and the dimensions of the fluid restricting passageway being selected so that when the valve is fully unseated and abuts the substantially flat end surface of said solenoid core, said greatest cross-sectional area of said valve is maintained within the conduit and the distance between the valve and the valve seat is greater than the width of the minimum cross-sectional area of the fluid restricting passageway, whereby the fluid restricting passageway presents the greatest restriction to fluid flow so that when the valve is unseated the pressure differential urging the unseated valve towards the valve seat is substantially greater than it would be if there was no such restriction to fluid flow from the fluid inlet chamber to the nozzle orifice.

2. An electromagnetically-operable fluid injector according to claim 1, wherein the valve is slidably fitted in the conduit and the fluid restricting passageway bypasses the conduit.

3. An electromagnetically-operable fluid injector according to claim 1, wherein the valve has a width and said conduit has a different width such that the width of said conduit is slightly greater than the width of said valve, thereby forming a gap which comprises the fluid restricting passageway.

4. An electromagnetically-operable fluid injector according to claim 1, wherein the valve is a ball valve.

5. A single point fuel injection system for an internal combustion engine including an electromagnetically-operable fuel injector according to claim 1 operable to inject liquid fuel into an air/fuel induction system, a source of liquid fuel, and means for feeding liquid fuel under pressure from said source to the injector.

6. A single point fuel injection system according to claim 5, wherein said means for feeding liquid fuel under pressure to the injector include a fuel passage which is bounded by the outer surface of the hollow body so that it extends at least partway around the hollow body, and said liquid fuel inlet arrangement comprises at least one short inlet passage which extends through the hollow body so as to connect said fuel passage to said chamber and which is adapted to direct fuel under pressure from said fuel passage into said chamber in a direction which is transverse to the axis of the core and the nozzle orifice.

7. An electromagnetically-operable fluid injector comprising:

a hollow body of magnetic material; said hollow body having a hollow interior forming a fluid inlet chamber;

a fluid inlet arrangement which communicates with the fluid inlet chamber such that fluid under pressure fed through it is fed directly into the fluid inlet chamber;

an injector nozzle which is carried by said hollow body, said injector nozzle having top and bottom ends, said top end of said injector nozzle having a nozzle orifice and a valve seat formed around said nozzle orifice;

a conduit extending from said fluid inlet chamber to said valve seat; said conduit having a width and communicating with the chamber at a top end and with the valve seat at a bottom end;

a solenoid core connected to the hollow body; said solenoid core tapering to a substantially flat end surface; said substantially flat end surface projecting into said fluid inlet chamber opposite the top end of said conduit and said injector nozzle; said solenoid core being substantially coaxially aligned with said conduit and said nozzle;

a solenoid winding wound around said solenoid core; and a valve of magnetic material, said valve having a width and an axial length; a portion of said valve having the greatest cross-sectional area of said valve in a direction transverse to said conduit being always located within said conduit; said valve cooperating with the valve seat to control fluid flow along a flow path from said fluid inlet arrangement through said fluid inlet chamber to said nozzle orifice;

said valve and said hollow body including the core, being in a magnetic circuit which is magnetized by energization of the solenoid winding, the valve being a movable part of the magnetic circuit and being located in a gap which is formed in that magnetic circuit between one pole, which is formed by the solenoid core, and another pole which is formed by that part of the hollow body which forms the periphery of the conduit, the valve being normally biassed to seat on the valve seat and shut off fluid flow from said fluid inlet chamber into the nozzle orifice and being unseated to allow fluid flow along said path to the nozzle orifice and thereby to effect fluid injection by a change in the state of energization of the solenoid winding;

said fluid inlet arrangement communicating with said fluid inlet chamber through a portion of the hollow body without passing through said solenoid core and said solenoid core flat end surface being substantially flat across its entire transverse extent, and said solenoid core end surface having a cross-sectional area substantially less than said greatest cross-sectional area of said valve;

the width of said conduit being slightly greater than the width of said valve thereby forming a restricted gap in part of the flow path from said fluid inlet chamber to the nozzle orifice; the projecting substantially flat end surface of said solenoid core and the valve seat defining a dimension therebetween; the axial length of said valve, the dimension between the projecting flat end of said solenoid core and said valve seat, and the restricted gap between said conduit and said valve each being selected so that when the valve is fully unseated and abuts the projecting substantially flat end surface of said solenoid core, said greatest cross-sectional area of said valve is maintained within the conduit and the distance between the valve and the valve seat is greater than the restricted gap between the valve and the conduit, whereby the restricted gap between the valve and the conduit presents the greatest restriction to fluid flow so that when the valve is unseated the pressure differential urging the unseated valve towards the valve seat is substantially greater than it would be if there was no such restricted gap to fluid flow along said part of said flow path.

8. An electromagnetically-operable fluid injector according to claim 1, wherein the valve is a ball valve.

9. A single point fuel injection system for an internal combustion engine including an electromagnetically-operable fuel injector according to claim 7 operable to inject liquid fuel into an air/fuel induction system, a source of liquid fuel, and means for feeding liquid fuel under pressure from said source to the injector.

10. A single point fuel injection system according to claim 9, wherein said means for feeding liquid fuel under pressure to the injector include a fuel passage which is bounded by the outer surface of the hollow body so that it extends at least partway around the hollow body, and said liquid fuel inlet arrangement comprises at least one short inlet passage which extends through the hollow body so as to connect said fuel passage to said chamber and which is adapted to direct fuel under pressure from said fuel passage into said chamber in a direction which is transverse to the axis of the core and the nozzle orifice.

11. An electromagnetically-operable fluid injector comprising:

a hollow body of magnetic material; said hollow body having a hollow interior forming a fluid inlet chamber;

a fluid inlet arrangement which communicates with the fluid inlet chamber such that fluid under pressure fed through it is fed directly into the fluid inlet chamber;

an injector nozzle which is carried by said hollow body, said injector nozzle having top and bottom ends, said top end of said injector nozzle having a nozzle orifice and a valve seat formed around said nozzle orifice;

a conduit extending from said fluid inlet chamber to said valve seat; said conduit having a width and communicating with the chamber at a top end and with the valve seat at a bottom end;

a solenoid core connected to the hollow body; said solenoid core tapering to a projecting end surface; said projecting end surface projecting into said fluid inlet chamber opposite the top end of said conduit and said injector nozzle; said solenoid core being substantially coaxially aligned with said conduit and said nozzle;

a solenoid winding wound around said solenoid core; and a valve of magnetic material, said valve having a width and an axial length; a portion of said valve having the greatest cross-sectional area of said valve in a direction transverse to said conduit being always located within said conduit; said valve cooperating with the valve seat to control fluid flow along a flow path from said fluid inlet arrangement through said fluid inlet chamber to said nozzle orifice;

said valve and said hollow body including the core, being in a magnetic circuit which is magnetized by energization of the solenoid winding, the valve being a movable part of the magnetic circuit and being located in a gap which is formed in that magnetic circuit between one pole, which is formed by the solenoid core, and another pole which is formed by that part of the hollow body which forms the periphery of the conduit, the valve being normally biassed to seat on the valve seat and shut off fluid flow from said fluid inlet chamber into the nozzle orifice and being unseated to allow fluid flow along said path to the nozzle orifice and thereby to effect fluid injection by a change in the state of energization of the solenoid winding;

said fluid inlet arrangement communicating with said fluid inlet chamber through a portion of the hollow body without passing through said solenoid core and said solenoid core projecting end surface being continuous across its entire transverse extent, and said solenoid core end surface having a cross-sectional area substantially less than said greatest cross-sectional area of said valve;

the width of said conduit being slightly greater than the width of said valve thereby forming a restricted gap in part of the flow path from said fluid inlet chamber to the nozzle orifice; the projecting end surface of said solenoid core and the valve seat defining a dimension therebetween; the axial length of said valve, the dimension between the projecting end of said solenoid core and said valve seat, and the restricted gap between said conduit and said valve each being selected so that when the valve is fully unseated and abuts the projecting end surface of said solenoid core, said greatest cross-sectional area of said valve is maintained within the conduit and the distance between the valve and the valve seat is greater than the restricted gap between the valve and the conduit, whereby the restricted gap between the valve and the conduit presents the greatest restriction to fluid flow so that when the valve is unseated the pressure differential urging the unseated valve towards the valve seat is substantially greater than it would be if there was no such restricted gap to fluid flow along said part of said flow path.

12. An electromagnetically-operable fluid injector according to claim 11, wherein the valve is a ball valve.

13. A single point fuel injection system for an internal combustion engine including an electromagnetically-operable fuel injector according to claim 11 operable to inject liquid fuel into an air/fuel induction system, a source of liquid fuel, and means for feeding liquid fuel under pressure from said source to the injector.

14. A single point fuel injection system according to claim 13, wherein said means for feeding liquid fuel under pressure to the injector include a fuel passage which is bounded by the outer surface of the hollow body so that it extends at least partway around the hollow body, and said liquid fuel inlet arrangement comprises at least one short inlet passage which extends through the hollow body so as to connect said fuel passage to said chamber and which is adapted to direct fuel under pressure from said fuel passage into said chamber in a direction which is transverse to the axis of the core and the nozzle orifice.

15. An electromagnetically operable fluid injector according to claim 11, wherein the projecting end of said solenoid core is flat.

16. An electromagnetically-operable fluid injector comprising:

a hollow body of magnetic material; said hollow body having a hollow interior forming a fluid inlet chamber;

a fluid inlet arrangement which communicates with the fluid inlet chamber such that fluid under pressure fed through it is fed directly into the fluid inlet chamber;

an injector nozzle which is carried by said hollow body, said injector nozzle having top and bottom ends, said top end of said injector nozzle having a nozzle orifice and a valve seat formed around said nozzle orifice;

a conduit extending from said fluid inlet chamber to said valve seat; said conduit having a width and communicating with the chamber at a top end and with the valve seat at a bottom end;

a solenoid core connected to the hollow body; said solenoid core tapering to a substantially flat end surface; said substantially flat end surface projecting into said fluid inlet chamber opposite the top end of said conduit and said injector nozzle; said solenoid core being substantially coaxially aligned with said conduit and said nozzle;

a solenoid winding wound around said solenoid core;

a valve of magnetic material, said valve having a width and an axial length; a portion of said valve having the greatest cross-sectional area of said valve in a direction transverse to said conduit being always located within said conduit; said valve cooperating with the valve seat to control fluid flow along a flow path from said fluid inlet arrangement through said fluid inlet chamber to said nozzle orifice, and the width of said conduit being nearly the same as the width of said valve so that said valve slides within said conduit; and a fluid restricting passageway bypassing the conduit having a top end, a bottom end and a minimum cross-sectional area, said passageway communicating with said chamber at its top end and with the valve seat at its bottom end and thereby providing a restriction in part of the flow path from said fluid inlet chamber to the nozzle orifice;

said valve and said hollow body including the core, being in a magnetic circuit which is magnetized by energization of the solenoid winding, the valve being a movable part of the magnetic circuit and being located in a gap which is formed in that magnetic circuit between one pole, which is formed by the solenoid core, and another pole which is formed by that part of the hollow body which forms the periphery of the conduit, the valve being normally biassed to seat on the valve seat and shut off fluid flow from said fluid inlet chamber into the nozzle orifice and being unseated to allow fluid flow along said path to the nozzle orifice and thereby to effect fluid injection by a change in the state of energization of the solenoid winding;

said fluid inlet arrangement communicating with said fluid inlet chamber through a portion of the hollow body without passing through said solenoid core and said solenoid core flat end surface being substantially flat across its entire transverse extent, and said solenoid core end surface having a cross-sectional area substantially less than said greatest cross-sectional area of said valve;

the projecting substantially flat end surface of said solenoid core and the valve seat defining a dimension therebetween; the axial length of said valve, the dimension between the projecting flat end of said solenoid core and said valve seat, and the minimum cross-sectional area of said fluid restricting passageway each being selected so that when the valve is fully unseated and abuts the projecting substantially flat end surface of said solenoid core, said greatest cross-sectional area of said valve is maintained within the conduit and the distance between the valve and the valve seat is greater than the width of the minimum cross-sectional area of the fluid restricting passageway, whereby the fluid restricting passageway presents the greatest restriction to fluid flow so that when the valve is unseated the pressure differential urging the unseated valve towards the valve seat is substantially greater than it would be if there was no such restriction to fluid flow from the fluid inlet chamber to the nozzle orifice.

17. An electromagnetically-operable fluid injector according to claim 16, wherein the valve is a ball valve.

18. A single point fuel injection system for an internal combustion engine including an electromagnetically-operable fuel injector according to claim 16 operable to inject liquid fuel into an air/fuel induction system, a source of liquid fuel, and means for feeding liquid fuel under pressure from said source to the injector.

19. A single point fuel injection system according to claim 18, wherein said means for feeding liquid fuel under pressure to the injector include a fuel passage which is bounded by the outer surface of the hollow body so that it extends at least partway around the hollow body, and said liquid fuel inlet arrangement comprises at least one short inlet passage which extends through the hollow body so as to connect said fuel passage to said chamber and which is adapted to direct fuel under pressure from said fuel passage into said chamber in a direction which is transverse to the axis of the core and the nozzle orifice.

* * * * *